US005760534A

United States Patent [19]

Bednářet al.

[11] Patent Number: 5,760,534

[45] Date of Patent: Jun. 2, 1998

[54] SPARK PLUG HAVING RING SHAPED AUXILIARY ELECTRODE WITH THICKENED PERIPHERAL EDGES

[75] Inventors: Jan Bednář, Chynov; Josef Šafrata, Horky, both of Czech Rep.

[73] Assignee: Brisk Tabor, a.s., Czech Rep.

[21] Appl. No.: 696,883

[22] PCT Filed: Dec. 6, 1995

[86] PCT No.: PCT/CZ95/00028

§ 371 Date: Oct. 22, 1996

§ 102(e) Date: Oct. 22, 1996

[87] PCT Pub. No.: WO96/20523

PCT Pub. Date: Jul. 4, 1996

[30] Foreign Application Priority Data

Dec. 23, 1994 [CS] Czechoslovakia ..... 3294-94

[51] Int. Cl.[6] ..... H01T 13/20

[52] U.S. Cl. ..... 313/141; 313/142; 313/123; 313/139

[58] Field of Search ..... 313/141, 142, 313/143, 144, 145, 123, 128, 130, 138, 139, 140; 123/169 EL

[56] References Cited

U.S. PATENT DOCUMENTS 1,461,405 7/1923 Solomon ..... 313/123

1,465,582 8/1923 Leager et al. .

1,621,581 3/1927 Clark ..... 313/123

FOREIGN PATENT DOCUMENTS 1.091.771 4/1955 France .

2 094 883 9/1982 United Kingdom .

WO93/26068 12/1993 WIPO .

*Primary Examiner*—Richard Chilcot

*Assistant Examiner*—Harshad Patel

*Attorney, Agent, or Firm*—Burns, Doane, Swecker & Mathis, L.L.P.

[57] ABSTRACT

A spark plug with improved wear resistance includes an outer conductive housing, a ceramic insulator positioned within the housing, and a central electrode inside the insulator. One or more ring-shaped auxiliary electrodes are positioned on the ceramic insulator between the central electrode and the outer conductive housing. The one or more ring-shaped auxiliary electrodes have a central portion and peripheral edges which are thickened with respect to the central portion. The spark plug provides a spark gap between the central electrode and the auxiliary electrode and between the auxiliary electrode and the conductive housing.

11 Claims, 2 Drawing Sheets

Fig. 1
PRIOR ART
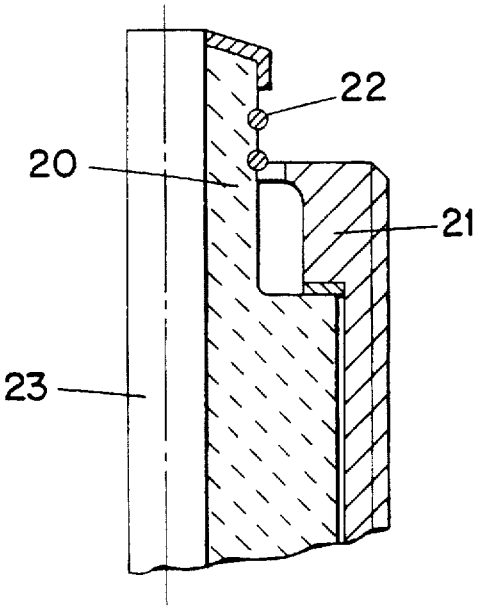
Fig. 3
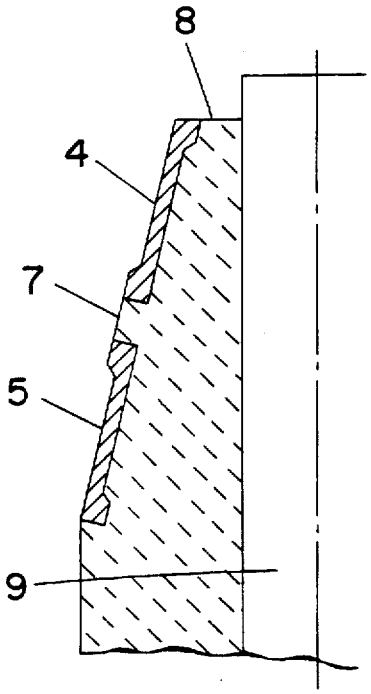
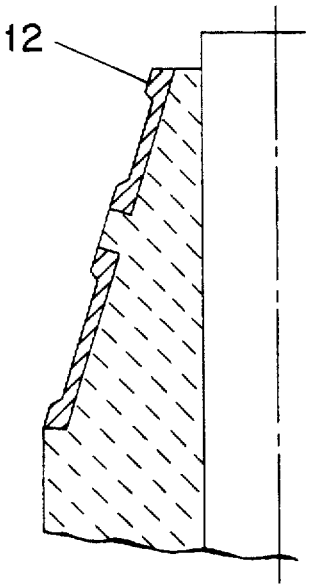
Fig. 4
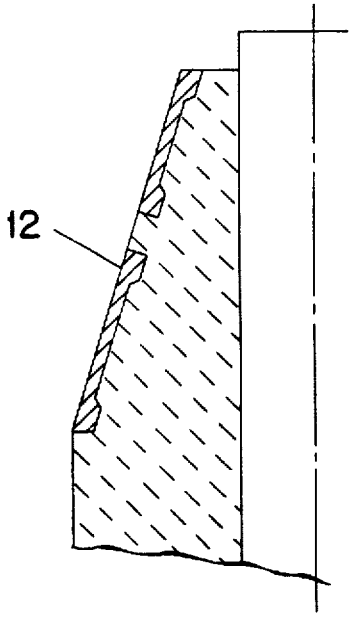
Fig. 5

SPARK PLUG HAVING RING SHAPED AUXILIARY ELECTRODE WITH THICKENED PERIPHERAL EDGES

FIELD OF THE ART

STATE OF THE ART

One of the problems of combustion engines is achieving the correct timing of the ignition of the fuel-air mixture which is directed to the combustion chamber or chambers and, that the spark is effective to ignite the fuel-air mixture. If the ignition is too slow or ineffective, fuel consumption and, hence, pollution increases and engine efficiency decreases.

Conventional spark plugs consist of a cylindrical ceramic insulator sealed in a steel body to form a gasproof device. One end of the steel body device is threaded to enable the spark plug to be inserted into the engine block. A central electrode is axially inserted into the ceramic insulator. A metal bolt, sealing the central electrode within the body of the insulator, serves as a high voltage input terminal. A ground electrode is positioned above the central electrode, electrically and mechanically coupled to the steel body. Both the central and ground electrodes operate in the engine combustion chamber.

Such a spark plug has a spark discharge on a small concentrated surface of the electrodes which causes erosion of the central electrode and, therefore, reduces the useful life of the plug.

Other types of spark plugs have multiple ground electrodes, for example, two or three electrodes. These electrodes are welded to the body of the plug. The ends of the electrodes are bent towards the central electrode. The ground electrode may also be formed as a single piece with plugs representing the active parts. However, even these types of spark plugs have a reduced life span due to wear and are also difficult and expensive to manufacture.

More effective and faster ignition of the fuel-air mixture and subsequently, more reliable engine operation can be achieved by spark plugs having a multispark discharge. In these types of spark plugs, as shown in FIG. 1, there is generally an arrangement of up to three auxiliary ring-shaped electrodes 22. These create a number of sequential spark gaps. The auxiliary electrodes are located between the central electrode 23 and ground electrode 21 around an end part of the ceramic insulator 20. The specially separated multispark discharges can then occur at the point of the highest concentration of the inflammable mixture. Therefore, these types of plugs are capable of igniting and burning very weak mixtures.

A spark plug of this type is described under U.S. Pat. No. 1,465,582. The central electrode is provided with a metal roof-shaped cup. The metal ring shape auxiliary electrodes, formed on the circular section, are elastically fitted into ceramic insulator grooves. The edge of the plug body has a rim which is bent towards the insulator. This spark plug has many disadvantages. During-shaped engine operation, at temperatures of 600° C. to 700° C., the metal ring-shaped electrodes lose their mechanical pre-stress. Owing to insufficient heat removal from the ring-shaped to the ceramic insulator, the ring-shaped electrodes overheat, wear out quickly and may burn up when overloaded. The roof-shaped cup of the central electrode of this type of spark plug is also overheated during-shaped engine operation. This is because the cup is not sufficiently thermally coupled to the insulator. The cross section of cup is inadequate for its heat absorption surface. The overheated cup and ring-shaped electrodes, therefore, increase the risk of self-ignition. Moreover, the steel rim can become dirty and may short-circuit the spark gap.

Another type of spark plug, using an auxiliary ring-shaped electrode, is described in UK Patent No. 2,094,833. Both the central electrode and auxiliary electrode are built into the plug body. The disadvantage of this system is that it is not possible to install the top of the ceramic insulator (i.e. the spark gap) into the best position within the combustion chamber. For the above reasons, use of these spark plugs has not been extended in practice.

BACKGROUND OF THE INVENTION

The arrangement of the spark plug under this invention considerably overcomes the disadvantages of the existing state of the art. The Spark plug comprises a solid, electrically and thermally conductive housing with a connecting means and in the inner cavity whereof a gasproof ceramic insulator, with a central electrode, is placed, and the protruding tip thereof, has at least one ring-shaped-shaped auxiliary electrode provided on the extended portion of the ceramic insulator forming a spark gap with the one end of the housing and with the central electrode.

It is the object of the invention that the peripheral edges of the auxiliary ring-shaped electrode are thickened. The lifetime of the spark plug increases since wear on the auxiliary electrodes is minimised in places where the discharge is concentrated.

The peripheral edges of the auxiliary ring-shaped electrodes may be thickened to form inner or outer collars which may, for example, extend inwardly into a recess in the insulator or may extend outwardly or may form a combination of both.

The auxiliary ring-shaped electrodes have at least two advantages; their peripheral edges are arranged to project in the same direction and this arrangement allows uniform wear of the auxiliary ring-shaped electrodes on both sides of the spark gap.

The auxiliary ring-shaped electrodes are formed of layers shaped into the surface of a truncated cone having thicker upper and lower peripheral edges conforming to the narrowing tip of the cylindrical ceramic insulator. This improves the heat dissipation from the top of the ceramic insulator and improves the overall temperature distribution.

The thickened outer edge of the auxiliary ring-shaped-shaped electrode situated at the top of the narrowing tip the cylindrical ceramic insulator is adjacent to the outward protruding end of the central electrode. The thickened inner edge of the auxiliary ring-shaped electrode is adjacent to the inner edge of the housing, formed at the end of its cylindrical head by way of an inner recess. Therefore, a plurality of spark gaps are provided for, which are positioned successively along the conical surface of the ceramic insulator. The gap between successive auxiliary ring-shaped electrodes may vary in size and may be different in width to the gap formed with the central and ground electrode. The inner recess of the edges of the metal body enables the top of the ceramic insulator to be cleaned and cooled when operating.

The thickness of the auxiliary ring-shaped electrode is 0.1 to 1.5 mm, while the peripheral edges extend by 0.2 mm. The common thickness of the auxiliary ring-shaped electrodes is 0.2 mm. These dimensions guarantee minimal heat inertia and adaptation in line with changes in engine operating mode. The auxiliary ring-shaped electrodes are formed of titanium nitride (TiN) and the housing is steel. Since the thermal expansivity of the ceramic insulator and of the auxiliary ring-shaped electrodes must be similar (within a range of ±15% to ±20%) TiN is used, which is one material which fulfills this condition.

LIST OF DRAWINGS

The invention will now be described in detail with reference to the accompanying drawings:

FIG. 1 shows a sectional view of a familiar spark plug comprising auxiliary ring-shaped electrodes in the form of split flexible metal rings;

FIG. 2 shows the basic arrangement of the multispark plug in accordance with the embodiment of the invention and FIGS. 3–5 show various arrangements of the auxiliary ring-shaped electrodes with thickened edges in accordance with the present invention.

PREFERRED EMBODIMENTS OF THE INVENTION

Figure 2:
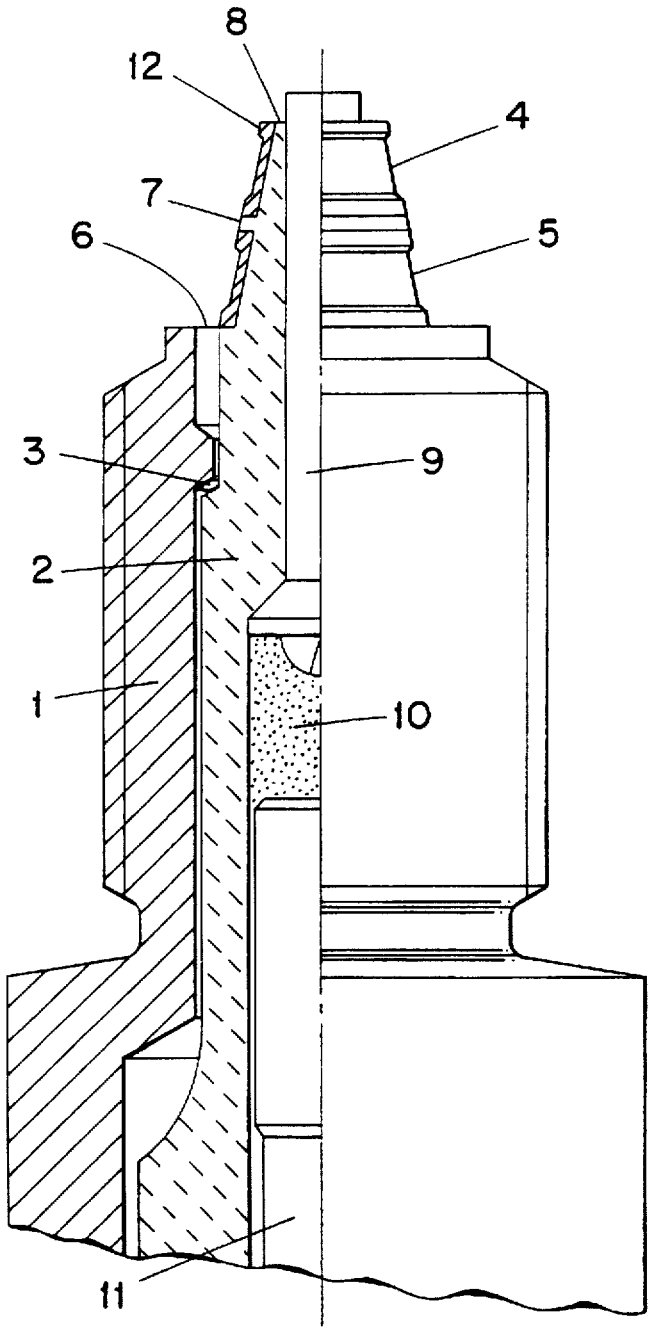

The spark plug comprises a steel outer housing 1 one end of which is threaded for assembly into the engine block and contains a ceramic insulator 2 placed axially in the cavity of the outer housing 1. The inner opening of housing 1 has a number of recessed regions. The ceramic insulator 2 rests on a metal ring 3, made of steel or copper.

The ring provides good contact between the outer housing 1 and the insulator 2. This results in the spark plug being gasproof and provides good heat conduction from the insulator 2 to the outer housing 1 and to the engine block. The cavity of the outer housing 1 has a gap in the threaded part of the housing 1 along the border of the inner cylindrical face of the outer housing 1.

The cavity of the outer housing 1 has a recess in its threaded part 1.

The housing 1 has an inner recess at the end of its threaded part 1. The ceramic insulator 2 is sized to the dimensions of the recess of the housing 1, such that the dimension tolerances of these parts enable them to be assembled with a defined clearance.

The ceramic insulator 2 comprises an axial inner cavity along its length. This cavity has several recesses. A central electrode 9 is positioned in the cavity of the insulator 2. This central electrode 9 is connected by means of a conductive seal 10 with a steel bolt 11, which serves as a high voltage input terminal.

The seal 10 containing copper or lead provides a gasproof seal between the steel bolt 11 and the central electrode 9.

This serves to separate the engine combustion chamber from the outside environment. In addition, the seal 10 provides an electrical connection between the steel bolt 11 and the central electrode 9. The part of the cylindrical ceramic insulator 2, which extends beyond the housing 1, tapers inwardly towards the outer end of the central electrode 9 forming a truncated cone shaped tip. From the position of the ring 3 towards the high voltage input terminal 11, the diameter of the insulator 2 gradually increases.

Two auxiliary ring-shaped electrodes 4 and 5 are provided on the cone shaped tip of the ceramic insulator 2. These ring-shaped electrodes are arranged to form a first spark-gap 6 with the upper end of the housing 1 and a second spark-gap 8 with the central electrode 9. A further spark-gap 7 is formed between the two auxiliary electrodes 4 and 5. The first spark-gap 6 is 0.4 mm to 1.5 mm in length. Preferably, it ranges from 0.6 mm–0.8 mm. Similarly, the other spark-gaps 7 and 8 are preferably 0.6–0.8 mm in length.

The auxiliary ring-shaped electrodes 4 and 5 are made from TiN layers formed into the general shape of a toroid having thicker upper and lower peripheral edges conforming to the shape of the tip of the insulator 2, that is, the inner diameter of the toroid at the upper peripheral edge, is less than the inner diameter of the toroid at the lower peripheral edge. The auxiliary ring shaped electrodes 4 and 5 as shown in FIGS. 3–5 each have a central portion between the peripheral portions or edges 12 which have a thickness which is smaller than a thickness of the peripheral portions. According to the embodiments of FIGS. 3–5, the central portions of the electrodes 4 and 5 are substantially frusto-conical in shape. The auxiliary electrodes 4 and 5 form a contact with the ceramic insulator 2 and since they are made of titanium nitride (TiN), the thermal expansivity of which is similar to that of the ceramic insulator 2, they remain in good contact with the insulator 2. The TiN layers are deposited on the insulator 2 by plasma technology, which enables the TiN to be deposited gradually in layers of molecular thickness. This method provides excellent adhesion and good heat transfer to the housing 1 and to the engine block. The thickness of the auxiliary ring-shaped electrodes 4 and 5 is approximately 0.2 mm, which guarantees minimal heat inertia, thorough heat transfer and adaptation to changes of engine operation mode.

The size of the spark gap 7 between the ring-shaped auxiliary electrodes 4 and 5 may be altered by varying the width between them. The ring-shaped auxiliary electrodes 4 and 5 have a width which can be freely varied and is only limited by the depth of the combustion area. The size of the second spark gap 8, located between the central electrode 9 and the upper auxiliary ring-shaped electrode 4, depends on the degree of tapering of the insulator tip. The spark can then be positioned at the most suitable place in the combustion area by altering the shape and dimensions of the insulator tip.

During operation, the auxiliary ring-shaped electrodes 4 and 5 are gradually eroded due to electric discharge. To extend their life, their peripheral edges facing the spark gaps 6, 7 and 8 are thickened. One end of the inner edge of the spark plug housing 1 created by the inner recess is close to the inner thickened edge of the lower auxiliary ring-shaped electrode 5.

The outwardly protruding end of the central electrode 9 is close to the outer thickened edge of the upper auxiliary ring-shaped electrode 4. The edges 12 of the ring-shaped electrodes 4 and 5 can be thickened either at the inner collar, i.e., recessed into the insulator, or at the outer collar, facing outwardly. The arrangement of the edge-collar 12 is such that the collars 12 are situated in the same direction so that the ring-shaped electrodes erode due to electric discharges, is thus uniform on both sides of the appropriate spark gap. The collars 12 are approximately 0.2 mm in thickness, although they can, of course, be thinner or thicker. Generally therefore, the entire thickness of the thickened edges of the auxiliary electrode 4 or 5 is approximately 0.4 mm. Too thin a layer erodes quickly due to electric discharge and chemical reactions at high temperatures etc., and too thick a layer would be difficult and time-consuming to manufacture.

The spark plug in accordance with this invention is intended for use in combustion engines.

We claim:

1. A spark plug comprising:

a solid, electrically and thermally conductive housing with a connecting means and an inner cavity;

a gas proof ceramic insulator, with a central electrode placed in the inner cavity; and a protruding tip of the central electrode having at least one ring-shaped auxiliary electrode provided on a protruding tip of the ceramic insulator, the at least one ring-shaped auxiliary electrode forming a spark gap with one end of the housing and with the central electrode, and the at least one ring-shaped auxiliary electrode having a central portion and peripheral edges at opposite ends of the central portion which are thickened with respect to the central portion.

2. A spark plug according to claim 1, wherein the peripheral edges of the ring-shaped auxiliary electrodes are thickened to form inner or outer collars.

3. A spark plug according to claim 2, wherein there are at least two ring-shaped auxiliary electrodes having inner or outer collars projecting in the same direction.

4. A spark plug according to claim 2, wherein the ring-shaped auxiliary electrodes are formed of layers shaped into the surface of a tapering tip of the cylindrical insulator, the thickened peripheral edges conforming to the tapering tip of the cylindrical ceramic insulator.

5. A spark plug according to claim 1, wherein there are at least two ring-shaped auxiliary electrodes having inner or outer collars projecting in the same direction.

6. A spark plug according to claim 5, wherein the ring-shaped auxiliary electrodes are formed of layers shaped into the surface of a tapering tip of the cylindrical insulator, the thickened peripheral edges conforming to the tapering tip of the cylindrical ceramic insulator.

7. A spark plug according to claim 1, wherein the ring-shaped auxiliary electrodes are formed of layers shaped into the surface of a tapering tip of the cylindrical insulator, the thickened peripheral edges conforming to the tapering tip of the cylindrical ceramic insulator.

8. A spark plug according to claim 7, wherein a first of the thickened peripheral edges of the ring-shaped auxiliary electrode situated at a top of the tapering tip of the cylindrical ceramic insulator is adjacent to an outward protruding end of the central electrode.

9. A spark plug according to claim 7, wherein a second of the thickened peripheral edges of the auxiliary electrode is adjacent to an inner edge of the housing, across an inner recess.

10. A spark plug according to claim 1, wherein the thickness of the ring-shaped auxiliary electrode is 0.1 to 1.5 mm, while the peripheral edges extend by 0.2 mm.

11. A spark plug according to claim 1, wherein the at least one ring-shaped auxiliary electrode is formed of titanium nitride (TiN) and the housing is steel.

* * * * *

UNITED STATES PATENT AND TRADEMARK OFFICE

CERTIFICATE OF CORRECTION

PATENT NO. : 5,760,534

DATED : June 2, 1998

INVENTOR(S) : Jan BEDNÁŘ et al.

It is certified that error appears in the above-indentified patent and that said Letters Patent is hereby corrected as shown below:

On the title page,

After United States Patent [19], please delete "Bednářet al." and insert therefor --Bednář et al.--.

Signed and Sealed this

Eleventh Day of August 1998

Bruce Lehman

*Attest:*

BRUCE LEHMAN

*Attesting Officer*

*Commissioner of Patents and Trademarks*